United States Patent [19]

Inhofer

[11] 4,296,672

[45] Oct. 27, 1981

[54] RECIPROCATING PISTON-CYLINDER COMBINATION AND VALVING CONTROL THEREFOR

[75] Inventor: Harold G. Inhofer, Hopkins, Minn.

[73] Assignee: Proteus Corporation, Minneapolis, Minn.

[21] Appl. No.: 93,876

[22] Filed: Nov. 13, 1979

[51] Int. Cl.[3] ..... F01L 15/16; F01L 25/06; F01L 23/00

[52] U.S. Cl. ..... 91/271; 91/309; 91/313; 91/342

[58] Field of Search ..... 91/313, 309, 271, 342, 91/265, 304, 305, 306

[56] References Cited

U.S. PATENT DOCUMENTS

| | | | |
|---|---|---|---|
| 1,084,009 | 1/1914 | Heany | 91/313 |
| 2,428,917 | 10/1947 | McFarland | 91/313 |
| 3,185,040 | 5/1965 | Ligon | 91/308 |

*Primary Examiner*—Paul E. Maslousky

[57] ABSTRACT

A piston-cylinder combination having a piston arranged for reciprocating movement within a cylinder under fluid pressure, the fluid pressure being ultimately delivered to the sides of the piston with a connector rod from the piston controlling the movement of valves for the delivery of fluid to the piston. The fluid valves are alternatively exposed to fluid under pressure to insure proper opening and closure thereof. The valving combination from the alternate sides of the piston eliminates chattering or floating of the piston, particularly when the piston is under a "no load" condition.

9 Claims, 8 Drawing Figures

RECIPROCATING PISTON-CYLINDER COMBINATION AND VALVING CONTROL THEREFOR

FIELD OF THE INVENTION

This invention relates generally to reciprocating pistons arranged within cylinders wherein the piston is driven under fluid power in both directions and is particularly related to the valving controls provided in association with such piston-cylinder combinations and is yet more particularly directed to a fluid control circuit for such piston-cylinder combinations wherein fluid under pressure retains the proper exhaust and inlet valves of the unit in their desired closed position.

BACKGROUND AND PRIOR ART OF THE INVENTION

Reciprocating piston-cylinder combinations wherein fluid is alternatively supplied to and exhausted from alternate sides of a piston to provide power for driving the same in both directions is well known in the art. The prior art similarly recognizes certain valving control mechanisms for such piston-cylinder combinations wherein the introduction of an exhaust of fluid from respective sides of the piston is controlled by movement of the piston within the cylinder and such units normally include a mechanical connection between the piston and a vlave construction to reverse the total fluid flow. Typical prior art disclosing such units exits in U.S. patents to Lane, U.S. Pat. No. 1,067,613; Noack, U.S. Pat. No. 575,614; Pedroia, U.S. Pat. No. 2,698,710;

Paschke U.S. Pat. No. 3,691,907; and such a device is also disclosed in a co-pending application for U.S. patent, Ser. No. 1,305, filed Jan. 5, 1979 and entitled "Fluid Pressure Servo Detent Mechanism."

The cited patent references all provide similar fluid shifting controls or valving arrangements, and may even, as the co-pending application discloses, provide a utilization of the inlet fluid pressure to insure positive closing of the outlet valves of the unit.

With those skilled in the art, the effect of piston chatter of the unit is well known. Often, under minimal or no load conditions and occasionally under other load conditions, the valving structures do not completely open nor completely close at certain instances of their operation and the fluid flow to the piston is not smooth with a resulting chattering effect. A particular instance of such chattering is at that point when the piston begins to shift the valving structure. At this instance, fluid, unless positively controlled, is free to flow in either direction and should, for example, any of the valves be partially open or closed, fluid may be shuttled back and forth between passages to result in piston chatter and non-positive movement thereof.

With the assembly and valving disclosed herein, this condition is prevented and rather the valves are rapidly moved or "popped" into their proper next position. This condition is true even through, for example, the piston is in what may be termed a "stationary position" at the end of a stroke. Upon the piston causing any movement of the exhaust valving structure, fluid flow is controlled in such a manner that all valving is automatically and rapidly shifted to its next position to smoothly redirect the flow within the unit and therefore cause movement of the piston to the opposite end of the cylinder.

SUMMARY OF THE INVENTION

The present invention provides a reciprocating piston end cylinder and system to control the inlet and exhaust fluid thereof. The piston-cylinder combination is provided with a pair of inlet valves, each of which has a first inlet end thereof arranged in parallel to control inlet fluid or as termed, "system pressure fluid, " passages to direct system pressure fluid to the opposite end or side of the valve when it is desired to close the same with the respective pressure areas of these valving members being determined to provide a positive fluid shut off upon the introduction of system pressure fluid to the rear or opposite side of the valving member.

The exhaust valves of the unit are normally opened by mechanical linkage to the piston and are positively maintained in their closed position by the introduction of fluid under system pressure to one side thereof while the opposite side thereof is exposed to fluid under no pressure or exhaust pressure.

The device of this invention then provides a fluid valving control mechanism for a dual driven piston-cylinder combination wherein positive opening and closing of the valving elements is obtained and maintained by mechanical and fluid linkages.

It is therefore an object of the invention to provide a reciprocating piston-cylinder combination and a fluid valve control mechanism therefore arranged and constructed to alternatively direct and exhaust fluid from opposite sides of the piston to drive the piston within a cylinder.

It is a further object of the invention to provide a dual driven piston-cylinder assembly with valving means to control the fluid being directed to and exhausted from opposite sides of the piston wherein the piston provides a first mechanical linkage to the exhaust portions of the valving mechanism and the actuation of the exhaust valving portions initiates and controls the fluid inlet flow through fluid or hydraulic linkages.

It is still a further object of the invention to provide a dual driven piston-cylinder combination and the valving mechanisms therefore wherein the inlet valving includes a pair of parallely arranged valves to receive fluid under system pressure and which includes conduit or passage means to selectively provide the opposite side or end of such valves to such system pressure to positively close a selected one of the valving means.

It is still a further object of applicant's invention to provide a dual piston-cylinder combination which allows for reciprocating movement of the piston within the cylinder wherein the exhaust valving means of the unit are, when in their closed position, positively maintained in such position through the application of fluid under inlet or system pressure to one side thereof.

These and other objects of the invention will more fully appear from a consideration of the accompanying description of a preferred and a modified embodiment of the invention.

DESCRIPTION OF THE DRAWINGS

The accompanying drawings are made in connection with the following description and throughout the various views the same indicia or numeral is utilized to identify the same or similar elements; and.

DESCRIPTION OF THE INVENTION

Figure 1:
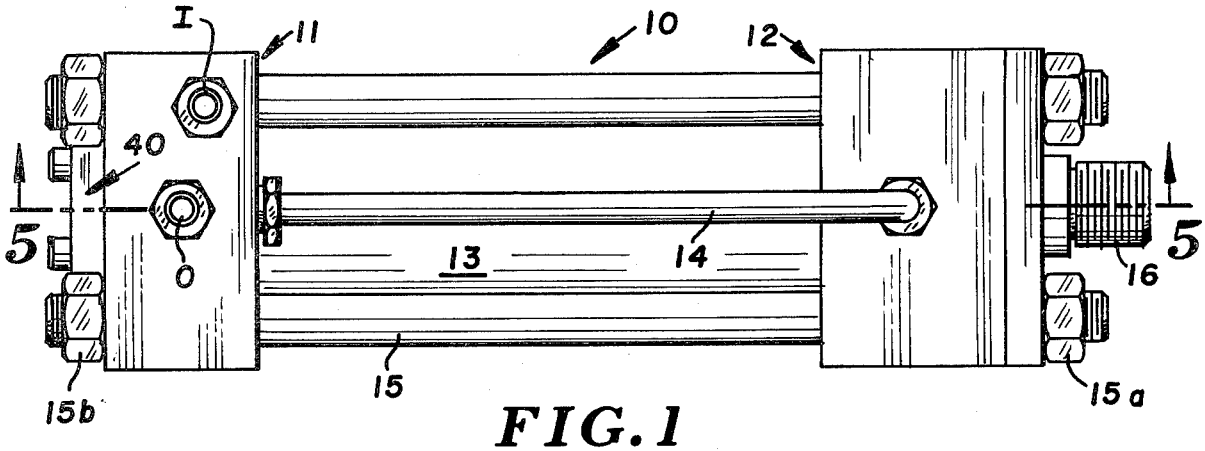
FIG. 1 is a top elevation of a piston-cylinder and valving mechanism embodying the concepts of the invention.
Figure 2:
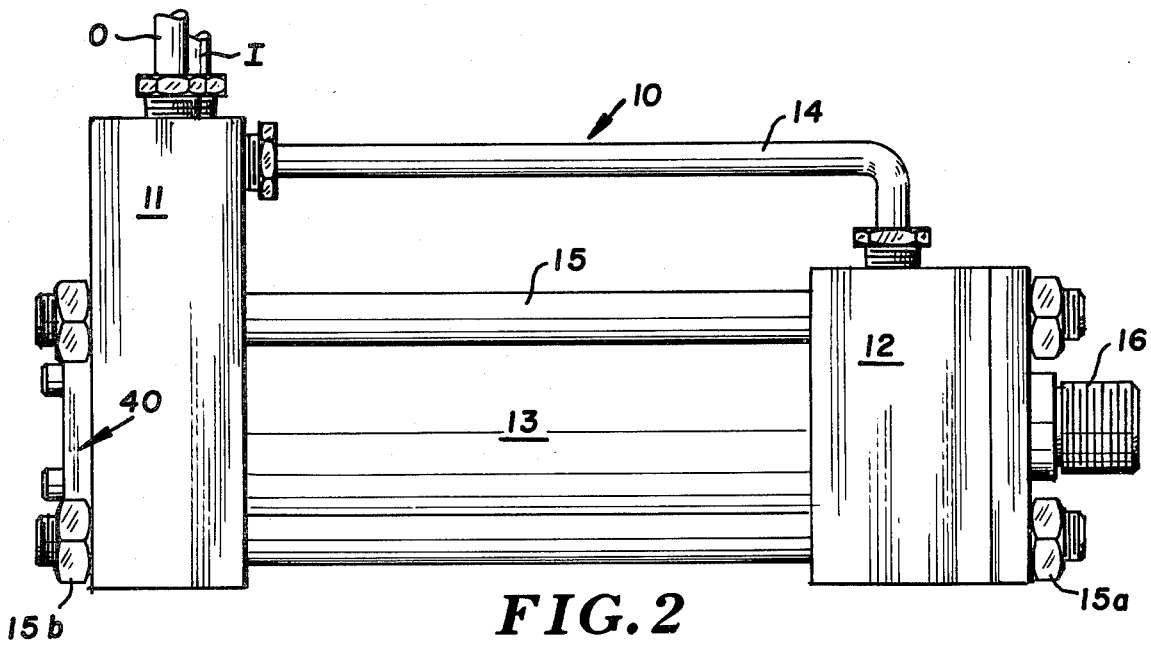
FIG. 2 is a side elevation thereof.
Figure 3:
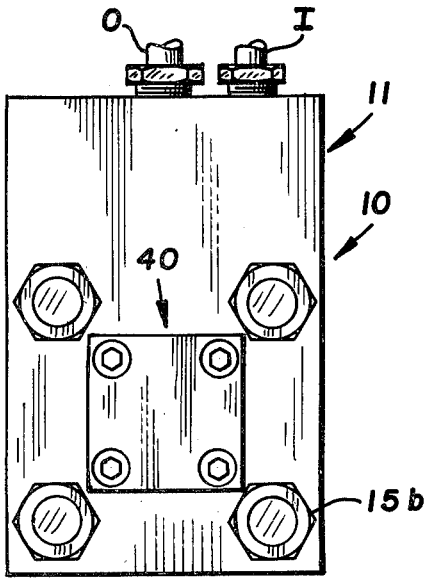
FIG. 3 is an elevation taken from a first end of the unit.
Figure 4:
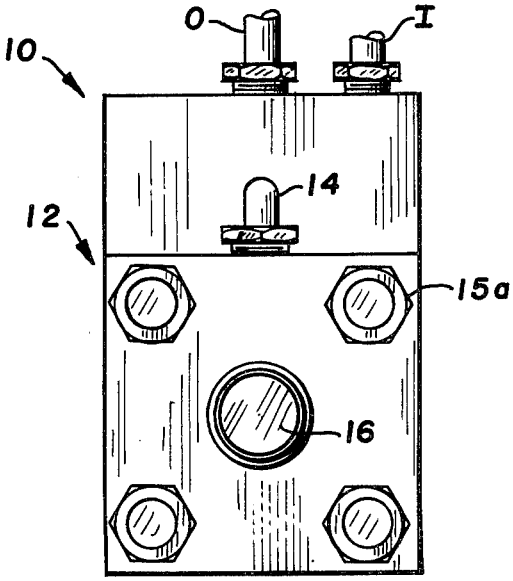
FIG. 4 is a view from the opposite end thereof.

In accordance with the accompanying drawings a reciprocating piston-cylinder assembly embodying the concepts of the invention is generally designated 10 and includes a first valving block 11, a second valving block 12 having a cylinder 13 positioned therebetween with a connecting conduit 14 providing communication between the valve blocks 11, 12 with the valve blocks 12, 13 being held in position against the ends of the cylinder 13 by a plurality of spaced connecting rods 15. The connecting rods 15 are provided to permit assembly and disassembly of the unit and this may be afforded by providing threaded ends thereon with capturing elements 15*a*, 15*b* respectively on the ends thereof.

A power output shaft 16 extends from the unit 10 and this shaft 16 is obviously connected to the reciprocating piston of the assembly.

In the form shown, a fluid inlet I and outlet O are arranged on the valving block 11 for the introduction of fluid to and receipt of fluid from the unit 10. Although these elements, I and O, and means are illustrated as being arranged on the upper surface of valving block 11, such is only a matter of illustration and it should be considered, throughout the course of this description, that various flow passages must be provided in the block 11 and the actual fluid flow as disclosed in the schematic diagram of FIG. 8 and the machining of a block 11 to conform with these flow passages is well within the knowledge and skill of a person skilled in the art.

Figure 5:
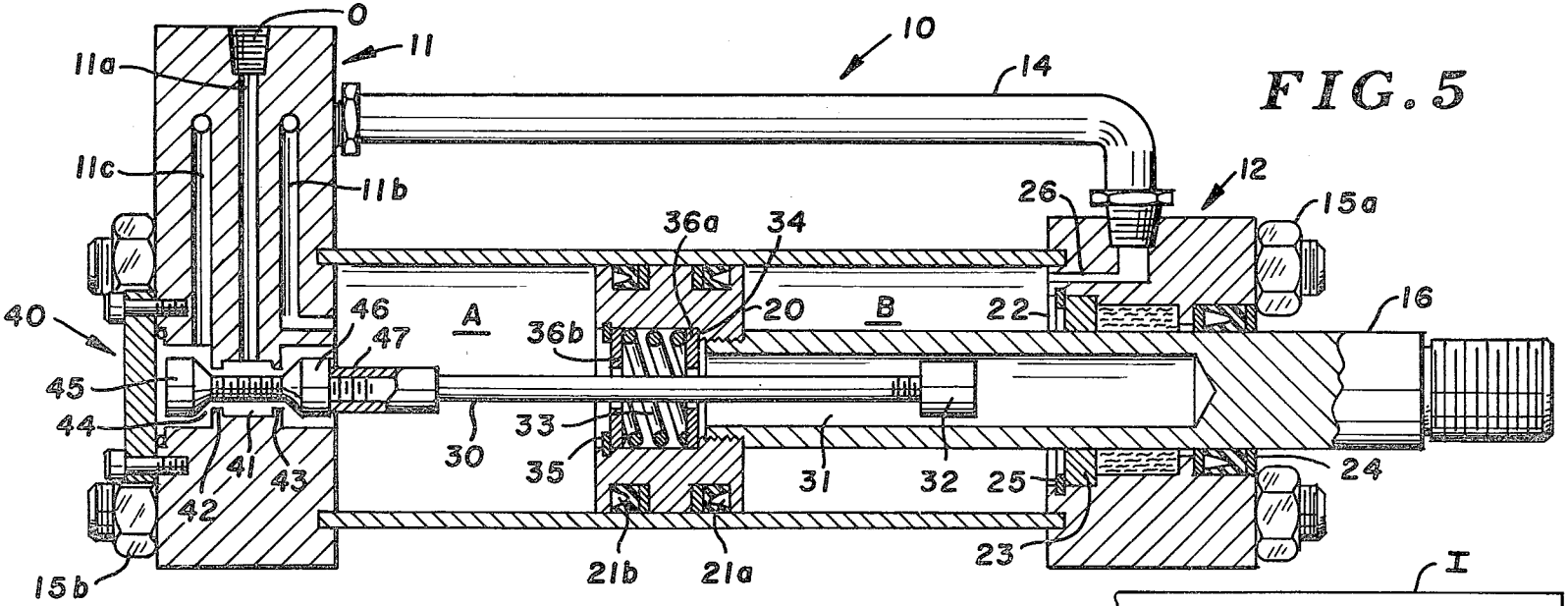
FIG. 5 is a vertical section taken substantially along line 5—5 of FIG. 1.

The structure, as illustrated in FIG. 5 provides the valving blocks 11, 12 and the cylinder 13 within which a movable piston 20 is positioned, which piston 20 is connected to the drive shaft 16 for movement thereof. Wiper and sealer members 21*a*, 21*b* are provided on the periphery of the piston 20 for sealing engagement with the interior walls of the cylinder 13. Valve block 12 provides an exit aperture 22 for the drive shaft 16 and this aperture is provided with necessary sealing glands such as at 23, wiping elements 24 and retaining elements 25 to prevent the flow of fluid from the cylinder while permitting reciprocation of the piston 20 and the accompanying reciprocation of driving shaft 16. Again, the particular construction is not new to the art and various means are commonly employable for such sealing arrangements. Block 12 is also provided with an interior passage 26 to communicate with conduit 14 for the delivery and receipt of fluid from one side of the piston 20 as the same is reciprocated within the cylinder 13.

As particularly illustrated in FIG. 5, an actuating rod member 30 is arranged for lost motion connection within and to the piston 20 and the associated drive shaft 16. This structure includes a longitudinally extending passage 31 formed within the piston 20 and a portion of the rod 16 with an abutment member 32 adjustably and positionably located on the actuator rod 30 within the passage 31. Arranged interiorally of the piston element 20 is a compression and actuation spring 33 retained therein by an interior shoulder 34 and a retaining ring 35 with abutment elements 36*a*, 36*b* arranged on opposed sides of the compression sping 33 such that the abutment element 36*a* will abut with the shoulder 32 of actuator rod 30 when, for example the piston is moved a desired extent, to the right of FIG. 5.

As stated, valving block 11 is provided with a plurality of passages to afford proper communication of fluid at system pressure for movement of the piston 20 and in the view of FIG. 5 through particular passages 11*a*, 11*b* and 11*c* are illustrated. Passage 11*a* communicates directly with the outlet O and passages 11*b*, 11*c* coordinate with the schematic illustration of FIG. 8.

A main control spool valve unit and valving area is provided in valve block 11 and is designated in its entirety 40. Within this area 40, an internal chamber 41 defining valve seats 42, 43 on the longitudinal ends thereof with a passage 44 therethrough is provided and the central area 41 thereof communicates directly with passage 11*a* to permit fluid to be discharged into the outlet O. The valving area 40 further defines a spool valve construction secured to the end of actuator rod 30 and includes a pair of valving members 45, 46 secured on such rod member 30 for movement therewith, the spacing therebetween being such that when one such valve member, for example 45, is seated against valve seat 42, the other such valve member 46 will be spaced from valve seat 43. This area then provides, alternately, communication between the outlet passage 11*a* and the chamber A, as defined by one side of the piston 20, interior of the cylinder 13 and valve block 11, such that fluid may be exhausted from such chamber A in a first position and likewise this spacing of valve members 45, 46 and seats 42, 43 permits communication between passage 11*c*, outlet passage 11*a* and chamber B, as defined by the opposite side of piston 20, interior of cylinder 13 and valve block 12, in a second position. Simultaneously, opening of one valve from its seat results in closure of the other valve to its seat.

As illustrated, a positionable stop member 47 is provided on the actuating rod 30 to abut with the aforementioned member 36*b* on one side of the compression spring 33 when the piston is moved to the left as illustrated in FIG. 5.

It should be obvious, then for the description to this point, to say that the valve arrangement 40 provides for exhaust of fluid from either chamber A or chamber B when the same is shifted by movement of piston 20. The effect of spring 33 is to provide a snap action for position movement of the valve elements 45, 46. The spring 33 initially compresses when contacting abutment elements 32, 47 but does, when the effect of system pressure is overcome by further movement of piston 20, provide a snap action to such valve elements.

Figure 6:
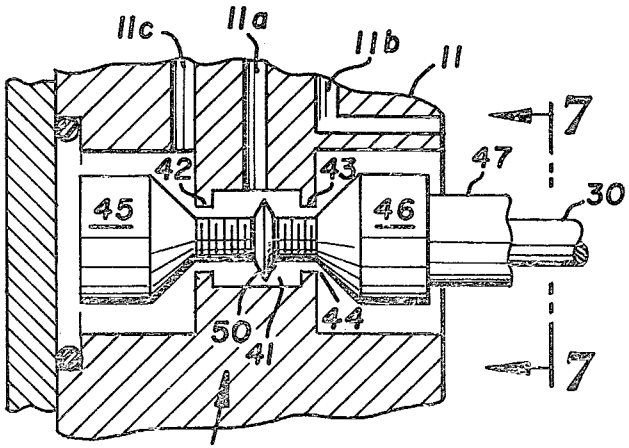
FIG. 6 is a view of the exhaust valving position of the unit illustrated in FIG. 5 illustrating a modification thereof and being drawn to an enlarged scale.

A modified form of this exhaust arrangement is illustrated particularly in FIG. 6. As illustrated therein, a sliding or floating baffle member 50 is provided on shaft 30 intermediate the two valving members 45, 46 and within the outlet chamber 41. It has been found, in certain installations, to be necessary to include this floating member between the valves 45, 46 and valve seats 42, 43 to insure that fluid entering such chamber 41 will be directed to outlet passage 11*a* rather than against the opposite valve, 45 or 46.

Figure 8:
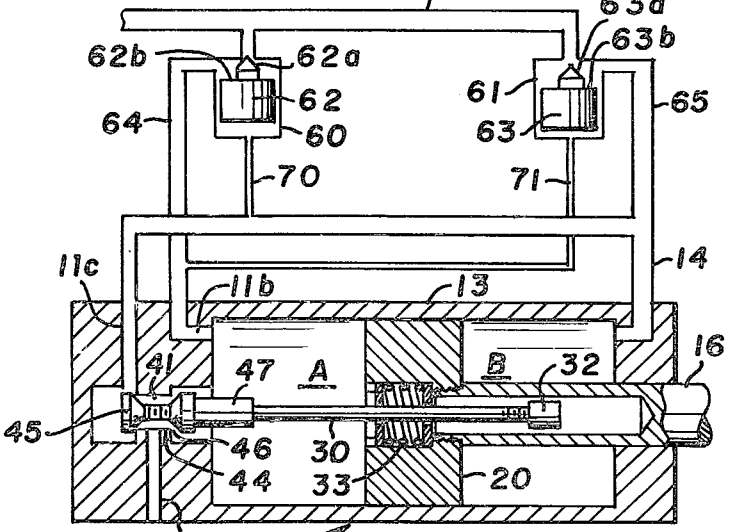
FIG. 8 is a schematic illustration of the fluid control circuit and the valving employed in the invention.
Figure 7:
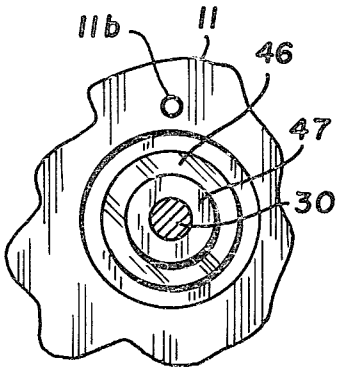
FIG. 7 is a vertical section taken substantially along line 7—7 of FIG. 6.

The valving system for fluid admission is best illustrated in the schematic diagram of FIG. 8. The inlet line again is designated I and provides system pressure to the unit and a pair of valving chambers 60, 61 are provided in parallel relation to receive fluid therefrom. Valving elements 62, 63 are arranged for reciprocating movement within chambers 60, 61 and a first valve seat 62*a*, 63*a* is provided on one end of each valve element 62, 63 to close communication between inlet I and the respective valving chamber 60, 61 and thus the remainder of the system. A first fluid directing conduit 64, 65 is provided in close relationship to such seating ends 62*a*, 63*a* of elements 62, 63 for the distribution of high pressure or system pressure fluid to the various portions of the unit. As illustrated, these respective conduits 64, 65 communicate with opposite sides of piston 20 to furnish fluid to move the same and, as shown, passage 64 communicates directly with the aforementioned passage 11*b* to direct fluid into chamber A and passage 65 communicates directly with connecting conduit 14 to provide inlet fluid to chamber B of the piston-cylinder combination. As also illustrated in FIG. 8, passage 11*c* likewise communicates with passage 65 and passage 14 for the exhausting of fluid through the shuttle valve arrangement 40 into passage 11*a*. Communication of exhaust fluid from chamber A to passage 11*a* is afforded directly through passage 44 into chamber 41 and thence into passage 11*a*.

A specific aspect of the invention is illustrated in the schematic drawing of FIG. 8 and as shown therein, pressurizing passages 70, 71 are arranged to deliver fluid to the rear of the valving members 62, 63 from the particular system pressure lines 64, 65. It should be noted that the rear pressure areas of the valving members 62, 63 against which system pressure fluid operates is different from that of seating area 62*a*, 63*a*. The area of valving members 62, 63 receiving fluid through lines 70, 71 is of a particular or selected large dimension in comparison with seating areas 62*a*, 63*a*.

With the fluid connections shown herein, rapid closing and opening of the various valve elements is obtained to insure non-chattering movement of the piston 20 and a typical operation and sequence of operation follows hereinafter: The illustration of FIG. 8 presents a condition in which the piston 20 is being moved to the left. In this condition, fluid at high pressure or system pressure is received through the valving arrangement 61 and system pressure exists in passages 65, 14 and 11*c* as well as within passage 70. Fluid transmitted through passage 14 causes expension of chamber B by pushing the piston 20 to the left. Fluid in passage 11*c* acts on the closure or rear side of valve member 45 to insure closure thereof against valve seat 42 and fluid within passage 70 acts on the rear side of valving member 62 to insure that the same is held against inlet fluid pressure from inlet I. It should, at this point, be noted that the greater area of the rear side of valve member 62 as compared with the inlet area of end or seat 62*a* insures such closure. At this same mode of operation, low or exhaust pressure exists in passages 64, 11*b* and 71, likewise in chamber A, the four of which are in communication with the outlet passage 11*a* through the valve seat 43, passage 44 and the outlet chamber 41. As the piston 20 is moved to the left, stop element 47 on actuator 30 abuts with the spring loaded area of the piston 20 thus driving the valve arrangement 40 to the left. Instantaneously with the shifting of the valve member 46 into closure position against seat 43, valve member 45 is displaced from seat 42 and a reversal of the positions of the inlet valving members 62, 63 takes place. At this instant, there is a pressure drop in conduit 70 and passage 11*c* to automatically open valve 62 against the inlet pressure from inlet I and this movement instantaneously brings conduits or passges 64, 71 and passage 11*b* to system fluid pressure to cause piston 20 to move to the right. Pressure in passage 71 causes immediate closure of valve member 63. Again, the pressure differential provided by the effective pressure areas of the valving members 62, 63 is of importance in this shut off. Pressure to and existing in Chamber A now assures that the valve member 46 is held in sealing relation to valve seat 44.

An important aspect of this particular fluid flow system is the utilization of the available inlet or system pressure. The most obvious use of this pressure is the driving of the piston, but with the arrangement as disclosed herein, this same pressure is utilized to insure the closure of exhaust valves from the chamber being filled and further to insure closure of the valving element controlling flow to the opposite side of the moving piston. This insurance is obtained through the introduction of fluid at such system pressure to the rear of the opposite inlet valve.

With the unit as disclosed herein, a unique, reciprocating piston-cylinder combination is provided which incorporates utilization of high pressure linkage and actuation of the valving elements included therein to insure rapid and positive movement of the same, even though the output portion is subjected to a no or very low load condition.

What is claimed is:

1. A reciprocating, piston-cylinder assembly and valving control therefore, including:

a. a cylinder;

b. a piston arranged for reciprocating movement within said cylinder;

c. means for providing fluid under pressure to said assembly;

d. a pair of inlet valving members receiving fluid under pressure and each being shiftable from a first open, fluid admitting position to direct fluid to one side of said piston for movement thereof to a second closed position;

e. said inlet valving members being fluidically connected to provide fluid under pressure from one of said valve members in said first position to the other of said valve members to positively hold said other of said valves in the second closed position; and, f. a pair of exhaust valving members arranged to exhaust fluid from said cylinder in response to the movement of the piston therein.

2. The structure set forth in claim 1 and said exhaust valving members being moveable from a first exhausting position to a second closed position and and said inlet valving members and said exhaust valving members being fluidically connected to provide fluid under pressure from said open inlet valving member to the one of said exhaust valving members in said second closed position for positive closing pressure thereagainst.

3. The structure set forth in claim 2 and said pair of exhaust valving members being shiftable from said first exhausting position to said second closed position in mechanically linked relation to the movement of said piston.

4. The structure set forth in claim 1 and said inlet valving members including a valve chamber and a reciprocating valve element therein one end of said valve element providing a valve seat of a first predetermined dimension for closure against said fluid providing means, the other end of said valve element being of a second dimension, said fluidic connection between said inlet valving members delivering fluid to said other end of said valve element.

5. The structure set forth in claim 4 and the dimensions of said one and said other end of said valve element providing a first small pressure seating area and a second, relatively larger pressure closure end to provide a pressure closure against fluid under inlet pressure.

6. The structure set forth in claim 1 and said pair of exhaust valving members being arranged in aligned relation on opposite sides of a first exhaust chamber and being sealable thereagainst, said valving members being mechanically linked and actuated by said piston.

7. The structure set forth in claim 6 said mechanical linkage including a rod member arranged for lost motion movement with said piston, said exhaust valving members being arranged in adjustable position on said rod.

8. The structure set forth in claim 7 and said exhaust valving members being spaced on said rod.

9. The structure set forth in claim 8 and a free floating, fluid diverting disc being positioned on said rod intermediate said valving members.

* * * * *